US008870746B2

(12) United States Patent
Carlson

(10) Patent No.: US 8,870,746 B2
(45) Date of Patent: Oct. 28, 2014

(54) FEMALE STIMULATION DEVICE

(76) Inventor: Courtney A. Carlson, New Albany, OH (US)

( * ) Notice: Subject to any disclaimer, the term of this patent is extended or adjusted under 35 U.S.C. 154(b) by 145 days.

(21) Appl. No.: 13/543,349

(22) Filed: Jul. 6, 2012

(65) Prior Publication Data

US 2013/0012769 A1 Jan. 10, 2013

Related U.S. Application Data

(60) Provisional application No. 61/505,438, filed on Jul. 7, 2011.

(51) Int. Cl.
*A61H 19/00* (2006.01)
*A61H 9/00* (2006.01)

(52) U.S. Cl.
CPC ..... *A61H 9/0071* (2013.01); *A61H 2201/105* (2013.01); *A61H 2201/0207* (2013.01); *A61H 2201/0157* (2013.01); *A61H 19/34* (2013.01)
USPC ..... 600/38

(58) Field of Classification Search
CPC ..... A61H 19/44; A61H 23/00; A61H 19/00; A61H 19/30; A61H 19/34; A61H 2201/0153; A61H 2205/087; A61H 33/027
USPC ..... 600/38; 239/526
See application file for complete search history.

(56) References Cited

U.S. PATENT DOCUMENTS

| | | | | |
|---|---|---|---|---|
| 6,464,653 | B1 | 10/2002 | Hovland | |
| 6,554,208 | B1 * | 4/2003 | Venuto, Sr. | 239/207 |
| 6,733,438 | B1 | 5/2004 | Dann | |
| 7,335,175 | B2 | 2/2008 | Heilman | |
| 7,588,533 | B2 | 9/2009 | Drysdale | |
| 2005/0279865 | A1 * | 12/2005 | Thomason et al. | 239/526 |
| 2007/0157985 | A1 * | 7/2007 | Caro et al. | 138/40 |
| 2009/0216076 | A1 | 8/2009 | Kain | |

* cited by examiner

*Primary Examiner* — Christine Matthews
(74) *Attorney, Agent, or Firm* — Porter Wright Morris & Arthur, LLP

(57) ABSTRACT

A female stimulation device contained in a housing to deliver pulsating positive air pressure to the clitoris and other regions of the female genital region having an air pump/compressor, a length of tubing connected to the air pump/compressor, a variable control on the pump to increase or decrease the frequency of the pulsation, a regulator to vary the positive air pressure, a pressure gauge attached to the pump outlet and the regulator, a container connected to the compressor to provide a means to include a lubricant and/or scent in the air flow. Various tips to direct the pulsating positive air flow and direct mechanical stimulation to the clitoris and nearby regions are connectable to the tubing outlet.

6 Claims, 5 Drawing Sheets

FEMALE STIMULATION DEVICE

FIELD OF THE INVENTION

The invention relates to a device to provide stimulation to the female genitalia, primarily the clitoris and other parts of the female vulva that contain multiple nerve receptors that are key to arousal and resulting in an orgasm. The invention allows the use of a flexible and or rigid tubing with various tips. The tips are easily placed on or near the clitoris area of the female providing direct positive pulsating air pressure from the tube. The tips are designed to provide direct pulsating air pressure to the clitoris.

BACKGROUND OF THE INVENTION

Clitoral stimulation as relates to female stimulation has been widely evidenced as a means to achievement orgasm. Many devices including vibrating design to enticing the clitoris and vacuum methods to enhance the sensitivity of the clitoris have been examined and are in use. A very effective way of stimulating the clitoris and region is the use pulsating positive air pressure to peen or to pulsate the clitoris by varying frequency as a means to create stimulation.

No prior art female stimulation device uses a current of positive air pressure. Existing stimulation devices typically mechanically vibrate or create a suction effect. These devices have to contact the skin to provide stimulation. Problems with existing devices include irritation and infections. A need exists for an invention that sexually stimulates a female yet eliminates irritation and or the risk of infection.

SUMMARY OF THE INVENTION

The present invention is directed to overcoming the problems set forth above. Briefly summarized, according to one aspect of the present invention, the current invention provides a positive air flow to create the stimulation of the clitoris from the air flow, rather than contact of the device. Pressure is referred to as "positive" when it exceeds atmospheric pressure and "negative" when it is less than atmospheric pressure. When a stream of air meets a stationary object, such as an airplane, air is deflected by the object and air currents are created. The currents flow, over, under, and around the object. When the direction of a stream of air or a liquid is changed, turbulence, such as vortices around a bridge piling in a river, are created.

The positive air flow pressure of the present invention creates a force applied over a surface per unit of area. The force per unit area applied in a generally perpendicular angle to the surface of an object creates a peening or concussion of the surface which it is directed to for stimulation. The combination of positive air flow, air pressure, and pulsating air pressure stimulates nerve receptors, creating sexual arousal to result in an orgasm.

The present invention is a female stimulation device to deliver pulsating positive air pressure to the clitoris and other regions of the female genital region. The device comprises an air pump/compressor, a length of tubing connected to the air pump/compressor, a variable control on the pump to increase or decrease the frequency of the pulsation, a regulator to vary the positive air pressure, a pressure gauge attached to the pump outlet and the regulator, and a reservoir connected to the compressor to provide a means to include a lubricant and or scent in the air flow. Various tips to direct the pulsating positive air flow to the clitoris and other parts of the region are removeably connectable to the tubing outlet. The tips are of different configuration to apply direct mechanical stimulation and or pulsating positive air pressure to the clitoris.

In an embodiment, the invention comprises a housing unit to contain the air pump/compressor. The housing unit may include a variable pressure control, regulator, reservoir, and other mechanical and electrical components. The housing unit may be disguised as a typical household item.

In an embodiment the invention is housed in a portable unit of similar design. The device may be battery operated with or without the means to have a portable charger which adapts to a standard home electrical outlet as the source for recharging.

In an embodiment, the invention is a positive air pressure and flow device to apply positive air pressure and flow to the female genitalia including but not limited to the clitoris, labia minora, labia majora, anus, nipples, and the like. The device includes an air pump, regulator, flexible tubing, and at least one tip. The air pump and regulator including other components are contained in a housing. The flexible tubing connects to the housing by any typical means used to connect a flexible tubing and effect a seal so as to not allow air to escape. The air pump is of any typical design, but types that are preferred are a diaphragm type or uni-piston type to deliver air pressure in a reciprocating manner as to be a rapid pulsation. Included in the housing is a reservoir or container used to contain scented and or lubricating oils that are added to and delivered with the positive air pressure for additional sensory stimulation.

As used herein, "concussion" means to shake violently, the action of striking together, to shock.

As used herein, "peen" means to impinge, impact, strike, collide, contact, hit or flick.

As used herein, "approximately" means within plus or minus 25% of the term it qualifies. The term "about" means between ½ and 2 times the term it qualifies.

The compositions and methods of the present invention can comprise, consist of, or consist essentially of the essential elements and limitations of the invention described herein, as well as any additional or optional ingredients, components, or limitations described herein or otherwise useful in compositions and methods of the general type as described herein.

Numerical ranges as used herein are intended to include every number and subset of numbers contained within that range, whether specifically disclosed or not. Further, these numerical ranges should be construed as providing support for a claim directed to any number or subset of numbers in that range or to be limited to the exact conversion to a different measuring system, such, but not limited to, as between inches and millimeters.

All references to singular characteristics or limitations of the present invention shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

Terms such as "top," "bottom," "right," "left," "above", "under", "side" "front" and "back" and the like, are words of convenience and are not to be construed as limiting.

These and other aspects, objects, features and advantages of the present invention will be more clearly understood and appreciated from a review of the following detailed description of the preferred embodiments and appended claims, and by reference to the accompanying drawings.

DETAILED DESCRIPTION

Figure 1:
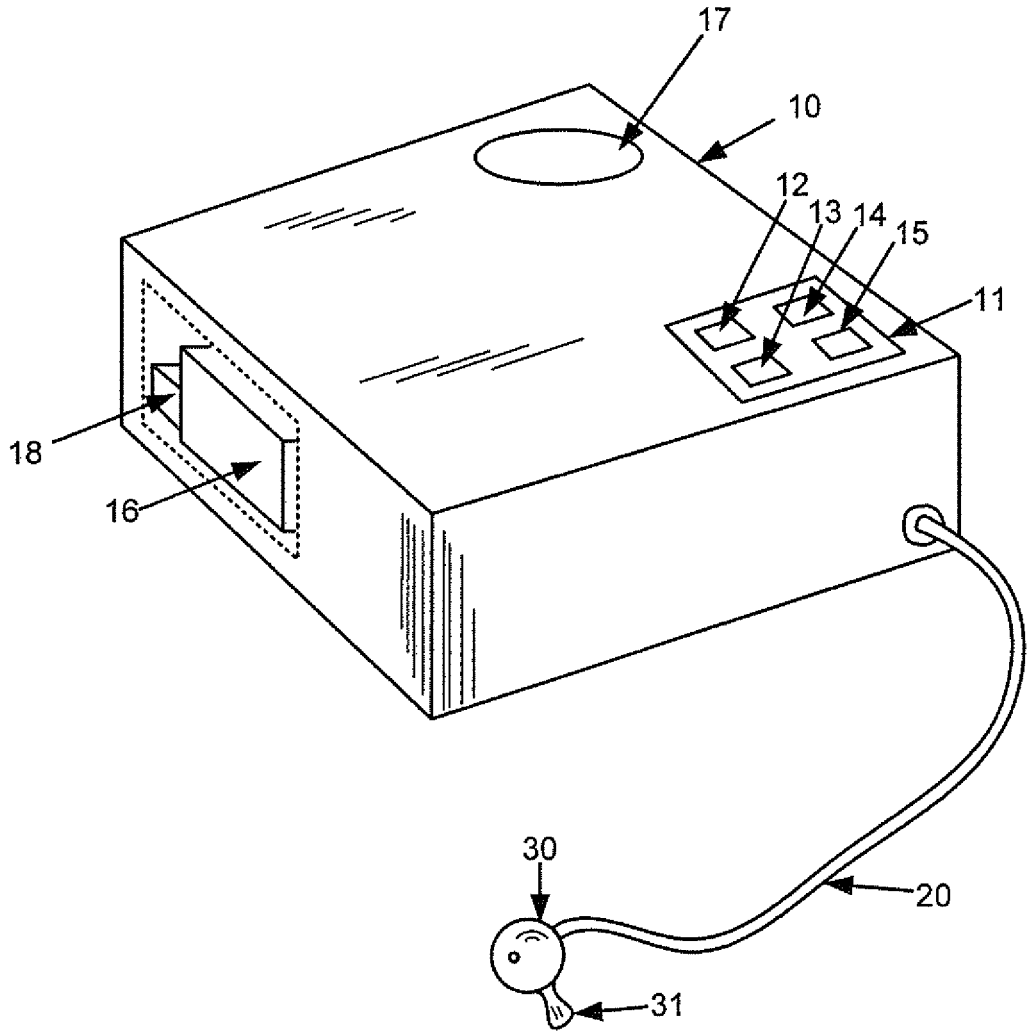
FIG. 1 is a perspective view of an embodiment of the invention.
Figure 2:
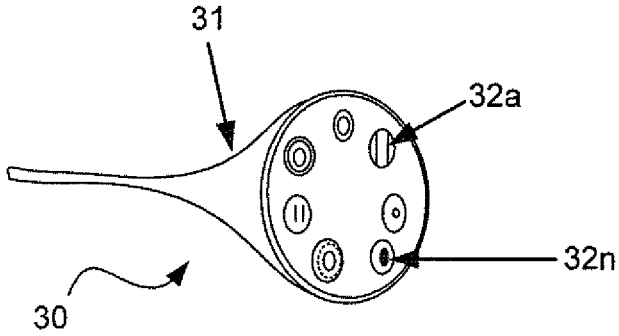
FIG. 2 is a perspective view an embodiment of a selectable nozzle.

Reference will now be made in detail to the exemplary embodiments of the invention, examples of which are illustrated in the accompanying drawings. As shown in FIG. 1, an embodiment of the present invention comprises a female stimulation device includes a housing 10, flexible tubing 20, and a tip 30.

The housing can have a light indicating "on", and includes a control panel 11. The control panel can have a switch 12. The switch can be translatable in more than one dimension. The switch can have a slide. The switch can have a rocker switch. The switch can have a wheel. The switch can be bi-functional. The switch can be a variable speed switch. The switch can be a depressible button. The switch can be configured to provide air pressure and pulsation control. The control panel switch 12 regulates components connected to various parts within the housing. The switch 12 can be used to turn the device on and off, regulate temperature 13, pressure 14 and pulsation 15. The housing houses the air compressor 16, a container 17 to hold a fluid, a gel, oil, or the like that is infused with a scent, and various electrical and ancillary components. The container may be heated by a heater (not shown) to increase the scent released and or heat the air flow. The container may comprise an atomizer, diffuser or other mechanism (not shown) to place tiny droplets of scented fluid in the air flow. The tubing is a hollow, flexible plastic tube connecting the pump to the container (preferably within the housing) and the tip. The tubing may have internal features, such as helical grooves (rifling), striations, and the like, to accelerate or add direction to the air flow. Air is received by the pump through a vent (not shown) in the housing.

The operation of the female stimulation device will now be described in more detail. An electric motor 18 is connectable to a power supply 50 (see FIG. 5). The power can be wired-electrical or battery, which can be rechargeable. The motor is connected to and operates the air compressor. The compressor supplies compressed air through the container and the tube. The compressed air exits the tube into the tip which is designed to direct the air flow. The air flow at from the tip is between about 10 psi to about 60 psi. A pressure regulator (not shown) regulates the amount of pressure as selected on the pressure dial. The maximum amount of air flow from the compressor is about 8-10 cubic feet per minute. A pulsation regulator (not shown) regulates the frequency of pressure as selected on the pressure dial. In an embodiment, the pulsation regulator variably opens and closes an air passage connected to the tubing by rotating a valve to produce alternating high and low air compression.

Figure 5:
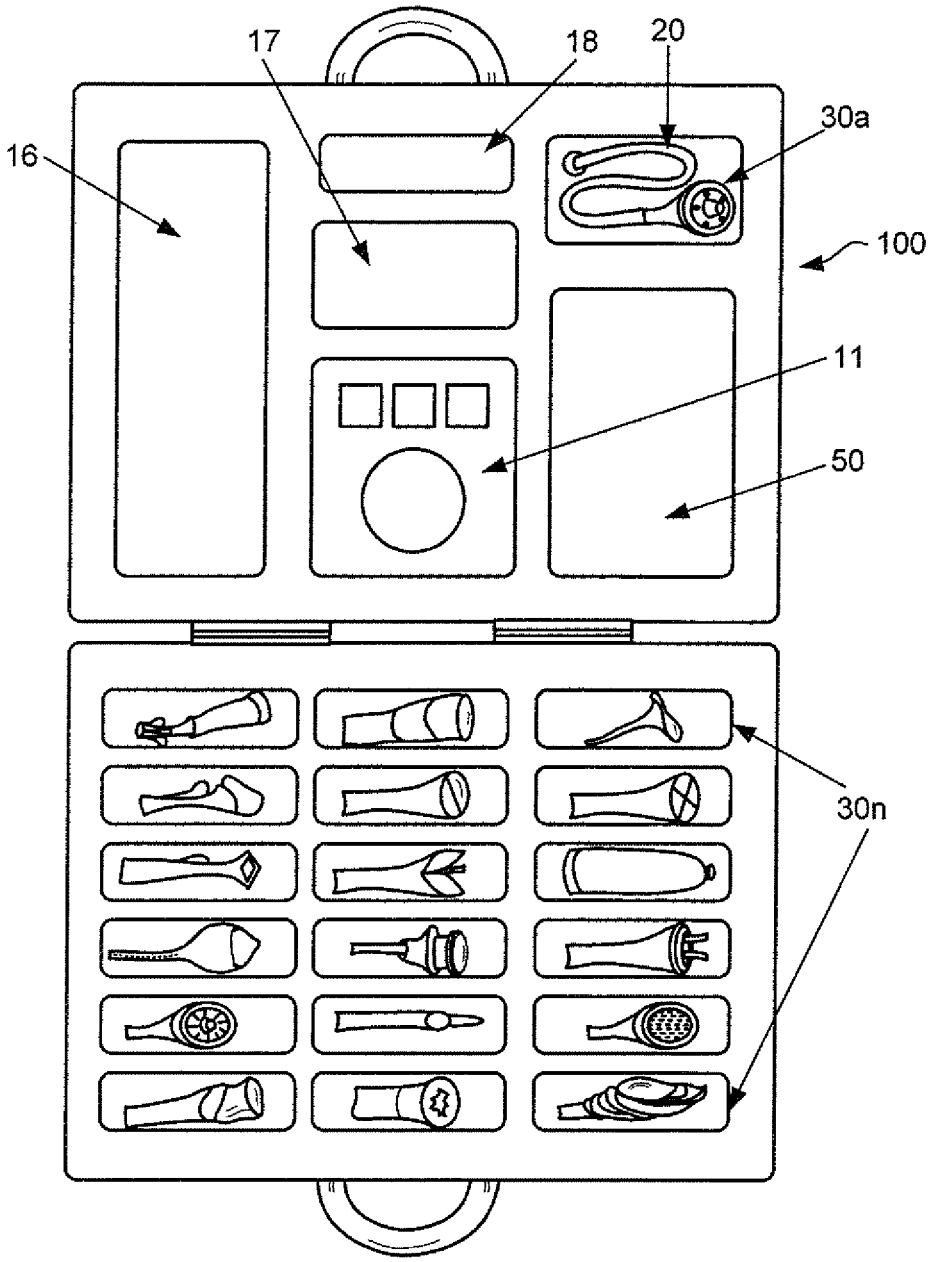
FIG. 5 is a top view an embodiment showing a kit with an array of tip designs.

Tips 30 are removeably connected in an air-tight fashion to the opposite end of the tube that is connected to the housing. Various tips may be included with the device or may be sold individually or in a set. Tips have any shape, such as rounded, flat, serrated, etc., which can act to direct the air in a certain pattern, in sheets or cascades. Tips vary in shape to create air turbulence, such as but not limited to a linear, laminar, vortex, oscillating, and the like. Tips may contain single or multiple openings. In an embodiment depicted in FIG. 12, a single tip contains multiple nozzles 32*a-n*, such as on an adjustable dial, that a user may individually select. The tip may include a handle 31 for the user to direct the air flow as desired. Additional tips 30*a-n* are shown in FIG. 5.

Tips are made of standard material readily available on the market such as silicone rubber or foam. The tip may include a flange ring. The flange ring is rigid but flexible to allow the user to place physical pressure on the clitoris for additional stimulation. The flange ring may comprise an internal spring or be made of a rigid material encapsulated with a softer more realistic feeling material such as silicone.

In an embodiment, the tip may be a sex toy, such as a dildo and the like. In an embodiment, the tip comprises flexible legs that contact the clitoris for additional stimulation. Alternately, the tip is spring loaded to be used for direct mechanical pressure and also to change the positive air pressure when pressed against the clitoris by varying the opening. Another tip contains multiple nozzles/openings and a rigid knob to apply direct mechanical pressure for stimulation.

The housing may be tabletop or a portable device. As depicted in FIG. 5, a portable device 100 can be a case with cavities to hold the components. The portable device contains the air pump/compressor 16, motor, electrical components 18, battery 50 and control panel 11, container 17, tubing 20 and tips 30*a-n*, The portable unit can be battery operated and rechargeable and includes a recharging stand or electrical cord with plug for charging via a standard electric wall outlet. The housing may comprise an external shell that provides a pleasing appearance and conceals the components. Exemplary shells are a wooden case, a jewelry box, a stack of books, a travel bag, and the like. Shells can be constructed from wood, glass, plastic, paper, fabric, metal, rubber, leather, combinations thereof, and the like.

Figure 3:
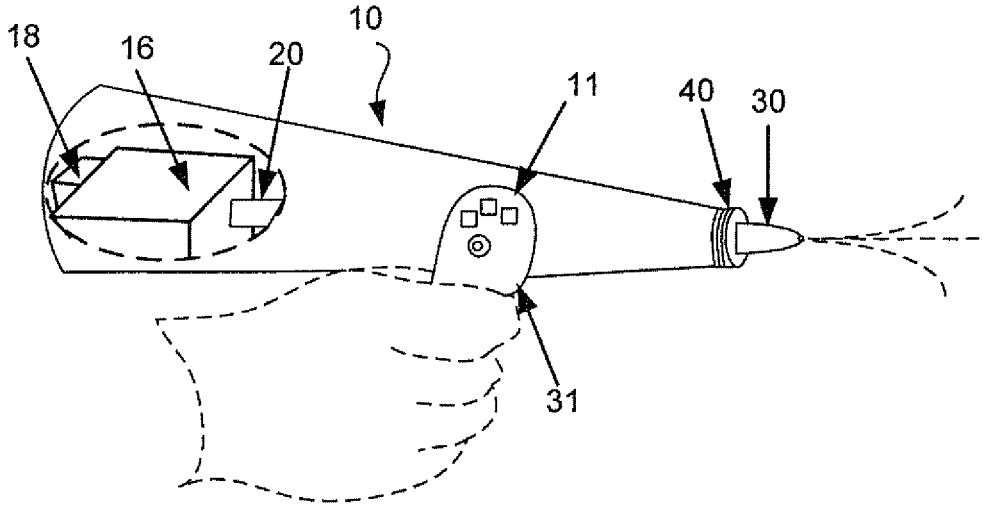
FIG. 3 is a perspective view an embodiment of the invention.

As shown in the embodiment depicted in FIG. 3, the housing may be hand-held. In this embodiment, the tubing in internal to the housing. The handle 31 is optionally a trigger that turns the device on and or regulates pressure and or pulse rate. The housing may include a neck 12 that can be articulated at fixed, stepped angles, or combinations thereof. For example, the neck 40 can have ribs configured to allow the tip 30 to rotate with respect to the housing.

Figure 4:
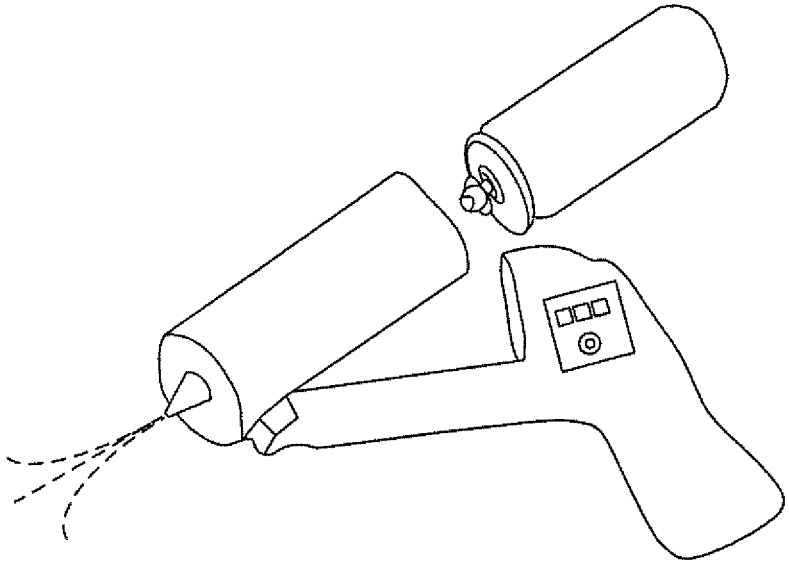
FIG. 4 is a perspective view an embodiment of the invention.

As shown in the embodiment depicted in FIG. 4, the housing may alternately accommodate a can of air that is dispensed when a trigger on the housing is depressed. The pulsation regulator and pressure regulator are adjusted to provide the desired pressure and pulse rate.

In an embodiment, the invention comprises means for releasable securing the housing, the tip, the tubing and or the handle to a user's pelvic area. In an embodiment, a strap or belt is connected to the housing, tubing, handle and or tip. In an embodiment, the strapping may include a sex toy attached to the tip such that the tip is positioned by the wearer at the clitoris of a partner. The strap is adjustable, and releasably secured by typical means, such as a buckle, snaps, hooks, a hook and loop material, e.g. VELCRO, placed on opposing faces of each end of the straps encircle the body at the hip or pelvic area and or around the legs. The housing may be attached at the back of the user with the tip strapped to the front. Alternately, the housing is a table top version with the strapping used only to position the tip. The straps can be a webbing material and or made from an elastic to hold the tip securely in position. The straps may include cushioned pads. The straps or positioned such that the user may change tips during use.

In an embodiment, the invention comprises at least two pieces of tubing connectable to an air source and individual tips, such that two or more people can use the same compressor at the same time. In the strap embodiment, each partner may use a tip strapped to his/her body to direct air flow to a partner's clitoris.

The foregoing descriptions of specific embodiments and examples of the present invention have been presented for purposes of illustration and description. They are not intended to be exhaustive or to limit the invention to the precise forms disclosed, and obviously many modifications and variations are possible in light of the above teachings. It will be understood that the invention is intended to cover alternatives, modifications and equivalents. The embodiments were chosen and described in order to best explain the principles of the invention and its practical application, to thereby enable others skilled in the art to best utilize the invention and various embodiments with various modifications as are suited to the particular use contemplated. It is therefore to be understood that within the scope of the appended claims, the invention may be practiced otherwise than as specifically described herein.

I claim:

1. A female stimulation device comprising:

(a) a shell selected from the group consisting of a wooden case, a jewelry box and a stack of books, the shell having a cavity receiving and concealing an air compressor and an electric motor, (b) a length of flexible tubing connected to an outlet of the air compressor, the tubing having an end, (c) a tip connected to the end of the tubing for directing positive air pressure to a clitoris, (d) a pressure regulator, and (e) a regulator for controlling air outflow, the outflow containing no liquid solution, to the tubing, the regulator comprising a variable and a pulsating control of air pumped through the tubing; the regulator linked to the pressure regulator.

2. The female stimulation device of claim 1 wherein the tip is a sex toy having an air outlet.

3. The female stimulation device of claim 1 comprising a container containing a scent connected to the tubing, wherein the compressor directs air flow through the container such that a scent is added to the air flow.

4. The female stimulation device of claim 1 wherein the tubing comprises an internal feature to accelerate or add direction to air flow.

5. The female stimulation device of claim 4 wherein the internal feature is at least one of a helical groove and a striation.

6. The female stimulation device of claim 1 wherein air flow from the tip is between about 10 psi to about 60 psi.

* * * * *